United States Patent [19]

Burger et al.

[11] 4,426,994

[45] Jan. 24, 1984

[54] HEATING FIREPLACE AND HEAT EXCHANGER FOR A HEATING FIREPLACE

[75] Inventors: Hans A. Burger, Worb; Wilhelm Gehrig, Glovelier, both of Switzerland

[73] Assignee: Kaminbau Burger's Sohne, Thorishaus, Switzerland

[21] Appl. No.: 277,075

[22] Filed: Jun. 25, 1981

[30] Foreign Application Priority Data

Jul. 21, 1980 [CH] Switzerland ..... 5556/80
Feb. 23, 1981 [CH] Switzerland ..... 1178/81

[51] Int. Cl.[3] ..... F24B 7/00; F24B 9/04

[52] U.S. Cl. ..... 126/121; 126/132; 126/143

[58] Field of Search ..... 126/120, 121, 131, 132, 126/143, 164; 237/51, 8 R

[56] References Cited

U.S. PATENT DOCUMENTS

| | | | |
|---|---|---|---|
| 712,672 | 11/1902 | Harrington | 126/132 |
| 1,152,912 | 9/1915 | Russell | 126/132 |
| 3,874,364 | 4/1975 | Fauser | 126/121 |
| 4,131,231 | 12/1978 | Cleer, Jr. | 126/132 |
| 4,159,801 | 7/1979 | Roland | 237/8 R |

FOREIGN PATENT DOCUMENTS

| | | | |
|---|---|---|---|
| 2270532 | 12/1975 | France | 126/132 |
| 2274001 | 1/1976 | France | 126/131 |
| 2398973 | 2/1979 | France | 126/132 |

*Primary Examiner*—Lee E. Barrett
*Attorney, Agent, or Firm*—Brady, O'Boyle & Gates

[57] ABSTRACT

The floor of the furnace space (fire chamber) of the heating fireplace is constituted by a horizontal, flat part (7) and the rear wall of the furnace space is constituted in part by a vertical, flat part (8) of a heat exchanger serving for heating water for a hot water heater. Heat is transferred to the water on the sides (38, 39) of the heat exchanger (7, 8) facing the furnace space, and to two fresh air currents on the sides (9, 41) of the heat exchanger (7, 8) facing away from the furnace space. One of these air currents (42) extends under the horizontal heat exchanger part (7) and is fed through an opening (15) therein to the fire as combustion air; the other air current extends in a downdraft duct (22) along the rear wall (8) of the furnace space and further through an updraft duct (25) exposed to the heat of the fire and is fed to the room to be heated as heated, fresh air.

9 Claims, 8 Drawing Figures

HEATING FIREPLACE AND HEAT EXCHANGER FOR A HEATING FIREPLACE

BACKGROUND OF THE INVENTION

The invention relates to a heating fireplace and to a heat exchanger for heating water in such a heating fireplace.

In heating fireplaces of this type, the room to be heated up is heated not only by the radiant heat of the fire but additionally also by recirculated room air, which is thus heated in the heating fireplace and/or by introduced fresh air, heated in the heating fireplace.

The object of the invention is to better exploit the combustion heat of such a heating fireplace, by providing that water is additionally heated and utilized, for example, as hot water and/or circulated in a water circulation system, especially a hot water heating system, so that the heating fireplace is capable of heating not only the room in which it is located and in which the vacuum (subatmospheric pressure) required for its operation must prevail, but is also capable of heating one or several other rooms wherein the hot water heating system is installed, wherein the pressure conditions in these other rooms make no difference. In this connection, the heating of the water is not to impair to any appreciable extent the heating of the air or the radiant heat from the heating fireplace. Besides, the flue effect, which is especially important in a heating fireplace (open fireplace), is not to be impeded by installations in the smoke discharge path.

SUMMARY OF THE INVENTION

In the invention, the flat heat exchanger forming a fire-exposed boundary for the air duct and/or for a partition between the air duct and the furnace space of the heating fireplace, which partition is to be traversed by the water, performs a dual function, differently from customary heat exchangers. Heat is not only transferred from the fire to the water and transmitted, for example, into the water circulation of the hot water heating system. In addition to this, heat is also transferred from the water, heated by the just-described heat transfer, to the air flowing through the duct. Thus, two heat transfer processes occur. During this procedure, heat is removed from the water on the side of the heat exchanger delimiting the air duct. Thereby, the water temperature drops, but the temperature difference between the water and the furnace space rises correspondingly, so that the water absorbs a correspondingly greater amount of heat from the fire. In this connection, the removal of heat can be practically compensated for by the increased heat absorption. The heat transfer to the water then causes practically no reduced air temperature in the air duct, and the heat transfer to this air does not ensue in a lower water temperature. More heat is withdrawn from the fire, and exploited. The heat removal only impairs the portion of the radiant heat from the fire which is reflected on the rear wall of the furnace space, which is negligible, because this is soot-covered, i.e. black wall is hardly reflective. As a consequence, the degree of efficiency of the heating fireplace is substantially raised by the water heating process, since the latter takes place additionally without appreciable impairment of the air heating step and the radiant heat. In this connection, the arrangement and construction of the heat exchanger require no modification of the furnace space whatever, and do not necessitate any installation above the furnace space which could deleteriously affect the smoke removal which is important especially in case of a heating fireplace (an open fireplace).

An especially advantageous further development of the invention resides in the construction by which fresh air is drawn in by means of a downdraft duct, exposed to the heat of the fire, by the vacuum produced in the room in which the fireplace is set up on account of the smoke gases rising up the chimney. This fresh air is heated up during this step and introduced into the room as heated-up fresh air, namely either from the lower end of the downdraft duct (Swiss Pat. No. 330,398) or from the upper end of at least one updraft duct exposed to the heat of the fire, the lower end of which updraft duct is connected to the lower end of the downdraft duct (Swiss Pat. No. 553,948). The latter not only has the result that the air heated in the downdraft duct is further heated in the updraft duct, but also provides the advantage that the updraft in the updraft duct exposed to heat of the fire supports the taking in of fresh air, so that a smaller vacuum in the room suffices for taking in the fresh air, and no blower is required for feeding fresh air; such blower is normally indispensable if the hot fresh air is conducted from the lower end of the downdraft duct directly into the room to be heated. If the lower end of the updraft duct is connected not only to the lower end of the downdraft duct but furthermore also by an opening with the room to be heated, then an air circulation heating effect is additionally achieved, since room air is drawn in through this opening which mixes with the heated fresh air rising in the updraft duct, is heated during this step, and is further heated in the updraft duct. A mixture of heated fresh air and reheated (circulated) room air is then fed to the room to be heated from the upper end of this duct. Also in this further development, the objective can be attained that the transfer of heat of the water does not effect any appreciable reduction in radiant heat and in heat transfer to the fresh air to be introduced into the room and to the recirculated room air, especially since the fresh air, after being heated by the heat exchanger, is additionally reheated in the updraft duct, as done in the embodiments described hereinbelow.

Additional advantages and developments of the heating fireplace and/or the heat exchanger are set forth in greater detail in the specification hereinafter following, by reference to the appended schematic drawings of two embodiments and versions thereof, in which.

Figure 1:
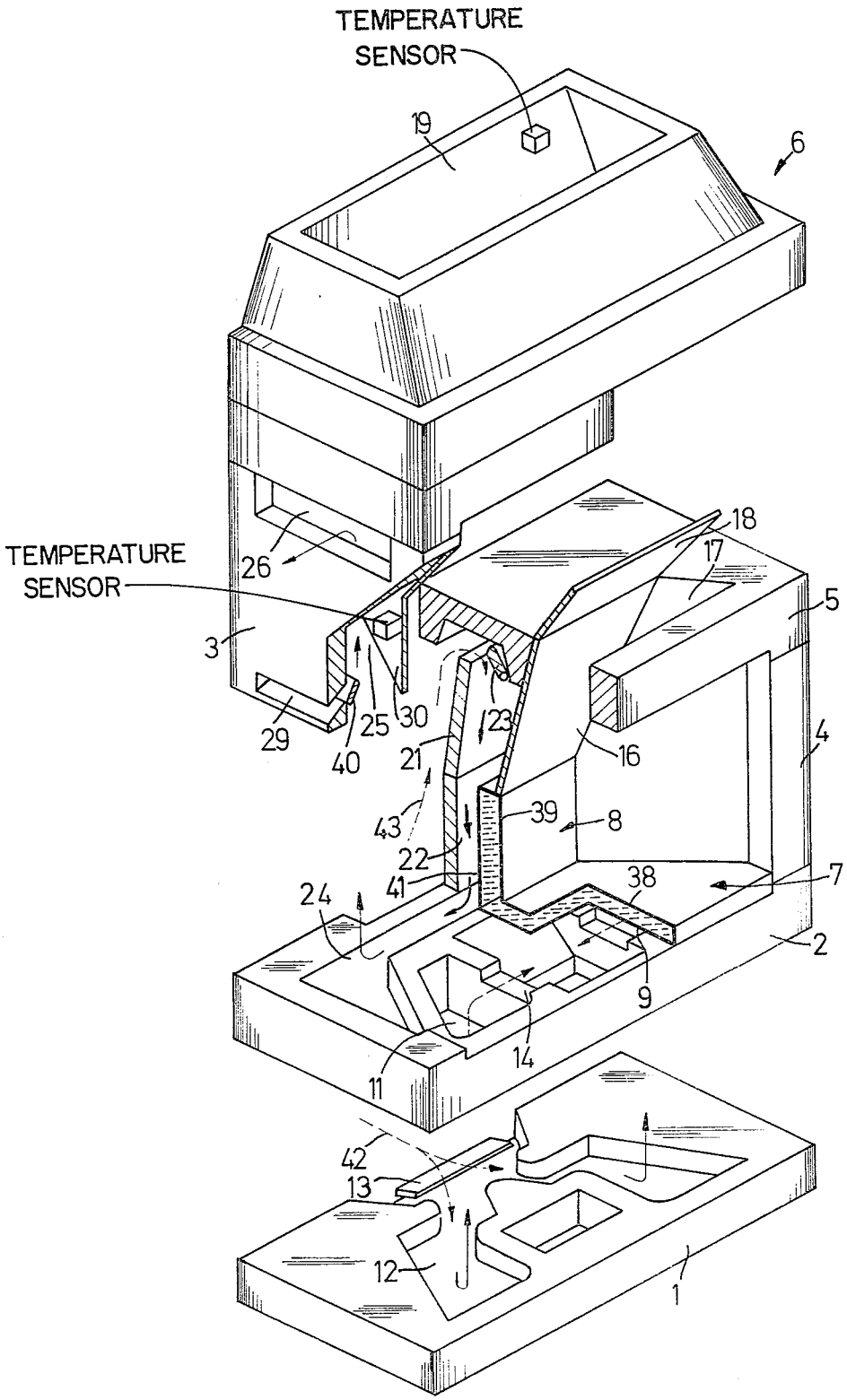
FIG. 1 is a perspective, lateral front view of a heating fireplace partially in section and in a partially exploded view.
Figure 5:
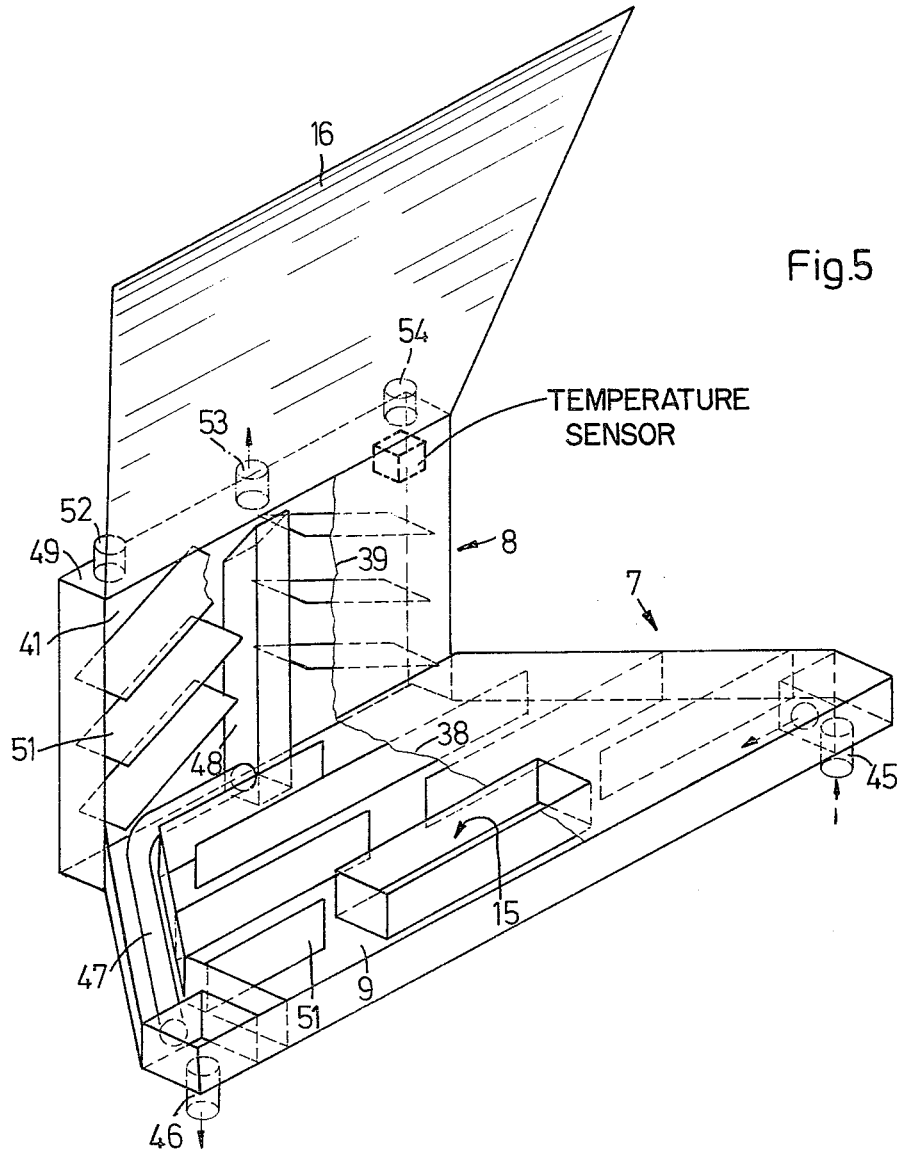

FIG. 5 is a perspective, lateral front view of another embodiment of the heat exchanger for the heating fireplace according to FIG. 1 on an enlarged scale, with the upper wall of the forward heat exchanger section and the front wall of the rearward heat exchanger section being partially broken away, shown together with a panel for separating the furnace space above the heat exchanger from the downdraft duct.

Figure 7:
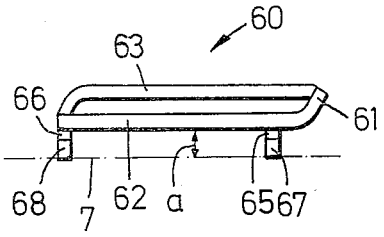
Figure 6:
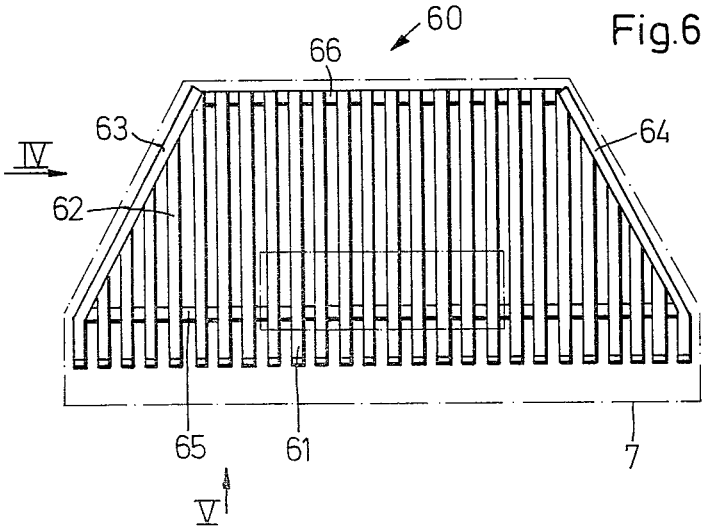

FIG. 6 is a top view of a fire grate of the heating fireplace,

FIG. 7 is a lateral view seen in the direction IV of FIG. 6, and

Figure 8:
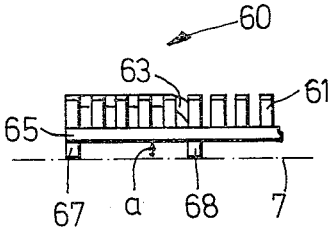

FIG. 8 is a partial front view in the viewing direction V in FIG. 6.

DESCRIPTION OF THE PREFERRED EMBODIMENTS

In principle, the purpose for which the water heated in the heat exchanger is utilized is of no importance for the present invention. To avoid repetition of exemplary usages, the invention is explained in conjunction with the example of heating up water for a hot water heating system. The disclosure applies analogously also to water being heated for other usages.

In FIG. 1, 1 denotes the base plate, 2 a bottom plate, 3 and 4 two mutually symmetrical lateral sections which define the furnace space along the sides, 5 is an end plate which, for the purpose of showing an exploded view, is cut into two halves, 6 is the smoke collecting element of the fireplace.

A heat exchanger for heating water for a hot water heater (not shown) consists of two parts 7 and 8 designed as flat boxes of sheet steel and being welded together at right angles to each other in such a way that their hollow spaces are in communication with one another. The thickness of the sheet metal is, for example, 5 mm, and the wall spacing is 60 mm, for example. The part 7 of the heat exchanger constitutes the floor of the furnace space and rests on the bottom plate 2. The lower wall 9 of this part 7 defines two draft ducts otherwise formed by respectively one opening 11 in the bottom plate 2 and an indentation 12 in the base plate 1. These draft ducts are in communication, on the one hand, via a control flap 13 for combustion air with the fresh air intake (not shown) on the outside of the building and, on the other hand, through cutouts 14 formed at the rim of the opening 11 and via the fire grate (not shown) arranged in a passage opening 15 of part 7 of the heat exchanger (FIGS. 2 and 4) with the furnace space.

The other part 8 of the heat exchanger forms a lower portion of the rear wall of the furnace space. A heat-conductive panel 16, for example of cast iron, adjoins the forward upper rim of this part 8 of the heat exchanger and constitutes the upper portion of the rear wall of the furnace space extending up to the rear edge of an opening 17 formed in the end plate 5; this opening 17 is provided with a control flap 18 and leads into the flue duct 19 of the smoke collector 6. A partition 21 extends at a spacing behind the rear wall 8, 16 of the furnace space from the bottom plate 2 up to almost the end plate 5. Between the partition 21 and the rear wall 8, 16 of the furnace space, a downdraft duct 22 is formed for fresh air coming from the fresh air intake, the flow of this fresh air being controllable by a regulating flap 23. The lower end of the downdraft duct 22 is in communication via an indentation 24 of the bottom plate 2 with the lower end of two updraft ducts, each of which is formed on the inside of one of the lateral parts 3 and 4. These updraft ducts are each separated from the furnace space by a heat-conductive panel 30, for example of cast iron, are in communication at the top via an opening 26 with the room to be heated, and can also have an opening 29 (with control flap 40) leading into the room to be heated, at the bottom, as has been mentioned as a further development. In the drawing, only the left-hand lateral section 3 shows the updraft duct 25 with the upper opening 26, the lower opening 29, and the flap 40, this duct being separated from the furnace space by the heat-conductive panel 30.

The heat exchanger 7, 8 of the heating fireplace can be utilized alone or in addition to a boiler, a solar collector, a heat pump, or some other device for heating water, or a reservoir yielding heated water and pertaining to the hot water heater. In this connection, the heat exchanger can be connected with one or several of such devices in series or, using mixing devices, in parallel thereto.

When the fire is burning, the upper wall 38 of part 7 and the front wall 39 of part 8 of the heat exchanger, which immediately adjoin the furnace space, are heated up. After the heating-up phase, the lower wall 9 of part 7 and the rear wall 41 of part 8 of the heat exchanger are likewise hot on account of the heat conductance of the heat exchanger jacket, the heat transfer from walls 38 and 39 to the water, the heat conductance through the water, and the heat transfer from the water to the walls 9 and 41. The air currents in the ducts or cavities of the heating fireplace are illustrated by arrows in FIG. 1, namely by dashed arrows for (cold) fresh air and by solid arrows for heated (preheated or reheated) air. Due to the flue gases withdrawn by the flue duct 19, a vacuum is produced in the room in which the fireplace is installed. Consequently, fresh air is taken in. Fresh air for combustion flows in the direction of branched arrow 42 into the cavities 11, 12 underneath the hot heat exchanger bottom 9 and passes as preheated combustion air through the cutouts 14 and the fire grate in the passage opening 15 of the heat exchanger (FIG. 2) to the fire. Fresh air to be fed to the room to be heated flows in the direction of arrow 43 to the upper end of the downdraft duct 22, is therein heated along the hot back side of the rear wall of the furnace chamber 16, 41, passes through the indentation 24 to the updraft duct 25 in the left-hand side section 3 exposed to the heat of the fire, and flows after the thus-accomplished additional heating through the opening 26 into the room to be heated, and does the same via the updraft duct (not shown) in the right-hand side section 4. The room is heated by the radiant heat of the fire as well as by the feed of heated fresh air. On account of the updraft in the updraft duct 25, room air is furthermore taken in through the opening 29, heated in the updraft duct, and mixed with heated fresh air coming from the downdraft duct, whereupon this air returns into the room through the opening 26. This also holds true for the updraft duct contained in the right-hand lateral section 4, which updraft duct is not illustrated. As a result, the air in the room is circulated and heated during this step, and heated fresh air is admixed thereto.

Simultaneously with heating the air in the ducts 11 and 22, the water flowing through the heat exchanger 8, 9 acting as an instantaneous water heater is also heated up.. In this procedure, the water temperature is not reduced—as could be expected—by the heating of the air and the air temperature is not decreased by the heating of the water; rather, as explained hereinabove, more heat is withdrawn from the furnace space and thereby the degree of efficiency of the heating fireplace is considerably increased.

Figure 2:
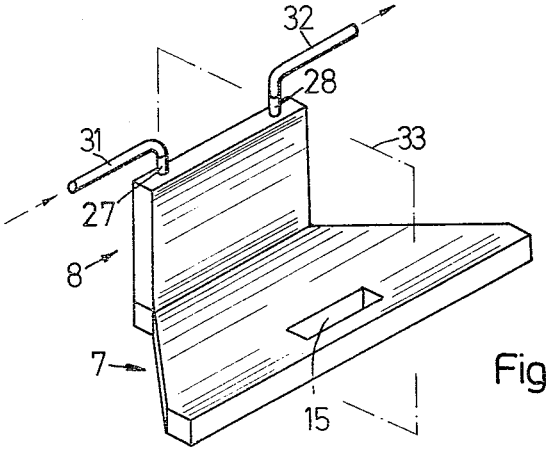
FIG. 2 is a perspective, lateral front view of one embodiment of the heat exchanger for the heating fireplace according to FIG. 1, with connecting pipe sections.
Figure 3:
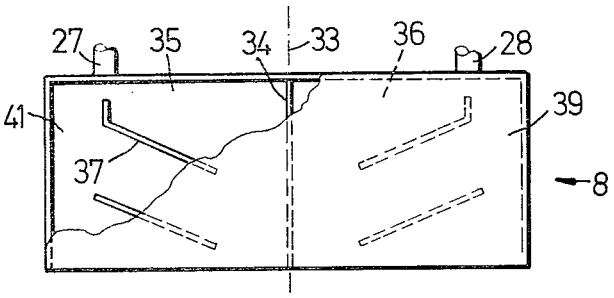
FIG. 3 shows a front view of one portion of the heat exchanger of FIG. 2 constituting a part of the rear wall of the furnace space and an air duct wall, illustrated on an enlarged scale, with the front wall partially broken away, and with baffles.
Figure 4:
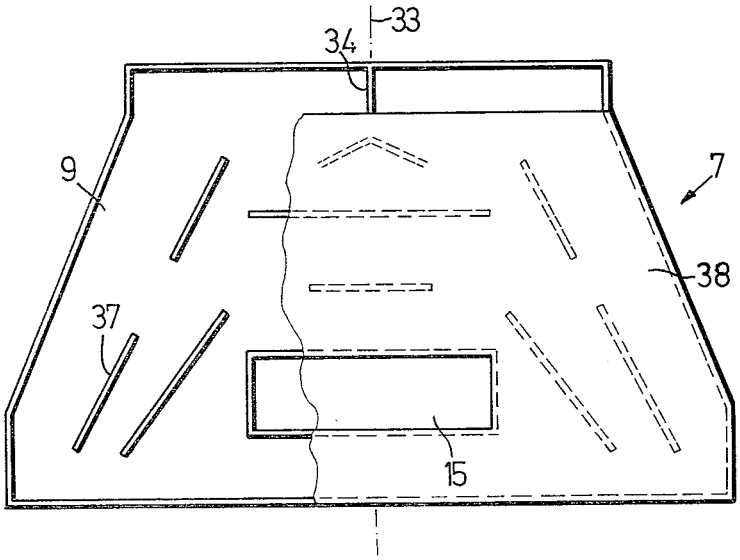
FIG. 4 is a top view of the portion of the heat exchanger according to FIG. 2 delimiting an air duct and the floor of the furnace space, on an enlarged scale, with the upper wall partially broken away, and with baffles.

The heat exchanger according to FIGS. 2–4 exhibits on an upper corner of part 8 a connecting nipple 27 for water feed and on the other upper corner a connecting nipple 28 for water discharge. Pipelines 31 and 32 are connected to these connecting nipples 27 and 28, connecting the heat exchanger 7, 8 with the water circulation system of the hot water heating unit (which otherwise is not illustrated). The conduit 31 is extended either laterally transversely through the updraft duct 25 of the lateral section 3 or downwardly through this duct 25 and thereafter through respectively one hole (not shown) in the bottom plate 2 and in the base plate 1 to the part of the hot water heater installed in the cellar of the house. The other conduit 32 is likewise extended through the updraft duct (not shown) in the other lateral section 4 either laterally therethrough or downwardly through this duct, the bottom plate 2, and the base plate 1. The panel 16 adjoins the forward upper edge of part 8 of the heat exchanger so that the connecting pipes 27, 28 and the adjoining portions of the conduits 31,32 extend within the downdraft duct where they are not exposed to the fire.

The heat exchanger according to FIGS. 2–4 is symmetrical to a vertical plane 33 running from the front toward the rear. The part 8 of the heat exchanger (FIGS. 2 and 3) is divided into two chambers 35 and 36 by a partition 34 extending to the bottom 9 of the heat exchanger (lower wall of the heat exchanger part 7). Baffles 37 are arranged in this heat exchanger oriented in the chambers 35 and 36 obliquely downwardly toward the partition 34 and/or plane 33 and, in part 7 of the heat exchanger, extending obliquely rearwardly toward the plane 33. A longitudinal rim of the baffles 37 is welded to one of the walls 9 and 38 or 39 and 41; the other longitudinal rim abuts so closely against the other of these walls that only an insubstantial portion of the water stream can pass the junction. This holds true correspondingly for the partition 34 (and also for the baffles 51 in FIG. 5).

From the return line of the water circulation from the hot water heating unit, water flows through the conduit 31 (FIG. 2) to the heat exchanger 7, 8, in part 8 thereof obliquely downwardly toward the plane 33 (partition 34, FIG. 3), and then in part 7 of the heat exchanger (FIG. 4) obliquely forwardly away from the plane 33, in front of the opening 15 toward the right, then rearwardly again toward the plane 33, and finally upwardly away from the plane 33 (partition 34) to the conduit 32 connected to the riser conduit of the water circulation. In this way, the water current in the zone of the heat exchanger most exposed to the fire heat is stronger than in the other zones. This is of significance in connection with the above-mentioned peculiarities [special features] of heat transfer to the water and to the air to be heated.

The heat exchanger according to FIGS. 2–4 is intended for water circulation by means of a circulating pump. For water circulation without circulating pump (thermal siphon circulation or so-called gravity operation), the water feed would have to be provided on the front side of part 7 and the water discharge on the upper side of part 8, respectively in the middle. The partition 34 would be omitted in such a case.

The heat exchanger of FIG. 5 differs from that shown in FIGS. 2–4 in that its inlet connecting nipple 45 and outlet connecting nipple 46 are arranged at the front corners of the lower wall (bottom) 9 of the heat exchanger part 7, so that the connecting conduits can be extended directly vertically downwardly through the cavity 11 of the bottom plate 2 and through the base plate 1 (FIG. 1). The inlet nipple 45 leads into part 7. The outlet nipple 46 is connected by a connecting pipe 47 extending above the bottom 9 of parts 7 and 8 to a stand pipe 48 which latter is arranged in the center of the length of part 8, is sealed at the bottom and open at the top. The stand pipe extends into the close proximity of the upper wall 49 of the heat exchanger part 8. Yet a flow cross section sufficient for the water flowing in the stand pipe 48 is ensured by the fact that the stand pipe 48 is cut off at a bevel at the top. Baffles 51 conduct the water current in part 7 repeatedly laterally to and fro and, in part 8, obliquely upwardly on both sides of the stand pipe 48.

A connecting nipple 52 for a conduit is arranged at the upper wall 49 of the heat exchanger part 8, this conduit leading to an automatic vent (not illustrated). This vent can be a float valve or a venting unit with expansion seal and is suitably arranged at a readily accessible location of the heating fireplace, for example in the opening 26 (FIG. 1). This prevents steam or air separated during heating of the water from accumulating at the top in the heat exchanger part 8 and forcing the water level to below the opening of the stand pipe 48, which could lead to disturbances in water circulation and overheating of the water in the heat exchanger.

The heat exchanger with the stand pipe of FIG. 5 is suitable for a heating fireplace utilized in connection with a hot water heater with circulating pump. For use in a water circulation by gravity (thermal siphon heating unit), a modification of the heat exchanger shown in FIG. 5 is suitable wherein the parts 46 through 48 are omitted and instead a water outlet nipple 53, illustrated in dot-dash lines in FIG. 5, is provided in the center of the upper wall 49 of the heat exchanger part 8.

If the heating fireplace is used for heating water for a hot water heater, which latter comprises still another source of hot water, e.g. a boiler or a hot water tank, the heated water fed by the boiler or the hot water tank and flowing through the heat exchanger would, when the fireplace is cold or in the heating phase of the fireplace, heat up the fireplace without adequate exploitation for the room in which the fireplace is located; with the regulating flap 18 (FIG. 1) being open, heat would then escape to the outside via the flue duct 19. In order to automatically prevent this from happening, a connecting nipple 54 is provided according to FIG. 5 on the upper wall 49 of the heat exchanger part 8; this connecting nipple serves for a dip pipe (not shown) with a temperature sensor for a two-position controller which interrupts water circulation through the heat exchanger as long as the temperature at the temperature sensor is lower than, for example, 60°–70° C. The controller can, for this purpose, cut out the circulating pump or, in case of water circulation by gravity, can close a valve connected in series with the heat exchanger. Such a temperature sensor can also be utilized in the heat exchanger of FIGS. 2–4. The same effect can be attained with a temperature sensor arranged in the flue duct 19 or in a hot air duct, for example in the updraft duct 25, which sensor responds to a temperature of, for example, 40° C.

The heating fireplace can be heated with a fuel of higher calorific value, namely coal or briquets, if a fire grate 60 (FIGS. 6, 7, 8) is located at a spacing a of, for instance, 3 cm above the heat exchanger part 7, this grate extending almost over the entire area of the heat exchanger part 7, namely set back only along the part or parts of its periphery lying on the open side or sides of the furnace space with respect to the corresponding side or sides of the heat exchanger part 7. In the present embodiment (FIG. 1), this is only the front side. At least on this side, the grate has a raised rim preventing the dropping especially of glowing pieces of the coal or briquets burning on the grate. In the illustrated grate 60, the forward ends 61 of the grate bars 62 are bent upwardly for this purpose, and respectively one rod 63 and 64 is arranged closely above the upper plane of the grate bars 62. The grate bars 62 are welded onto a forward traverse and a rearward traverse 65 and 66, respectively. Respectively one foot 67 is welded to the ends of the forward traverse 66 and respectively one foot 68 is welded to the ends of the rearward traverse 66. The feet 67 and 68 carry the grate at a spacing a above the heat exchanger part 7.

The grate 60 provides optimum combustion of coal or briquets across practically the entire bottom of the furnace space, in that the combustion air passes through the opening 15 into the interspace between the upper wall 38 of the heat exchanger part 7 and the grate 60 and from there between the grate bars 62 to the fire. Coal and briquets require more combustion air due to their higher calorific value, and develop more flue gas than wood burning. It has been found surprisingly that a heating fireplace of the type discussed herein satisfies the requirements for heating with coal or briquets by providing that the feed point for the combustion air is suitably located and the connecting duct to the space 12 underneath the furnace space bottom and/or the heat exchanger part 7, as well as the opening 15 therein, are dimensioned in correspondence with the higher demand for combustion air, and the flue system is dimensioned in accordance with the greater volume of flue gas produced. It is especially surprising that, in spite of the open fireplace, a completely adequate removal of the flue gases can be attained. This is due to the fact that the present heating fireplace requires, for taking in the fresh air, a lower vacuum in the room than other open fireplaces (heating chimneys) and closed fireplaces (room furnaces). The vacuum in the room to be heated counteracts the removal of the flue gases; it tends to suck the flue gases into the room in counteraction to their thermal updraft. Thus, a lower vacuum enhances the drawing away of the flue gases. And such a lower vacuum suffices in the present heating fireplace for taking in the fresh air, because the air in the updraft ducts (updraft duct 25 in the left-hand lateral section 3 and the corresponding updraft duct in the right-hand lateral section 4) has been preheated in the downdraft duct 22, i.e. already exhibits updraft, and additional updraft is imparted thereto by the feature that this air is additionally heated further in the updraft ducts heated by the fire. Another essential aspect in this connection is that on account of the present heat exchanger the removal of smoke is not impeded by installations in the flue duct system.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

What is claimed is:

1. A fireplace for heating living areas, rooms and the like by heat radiation of the fire and by a hot air stream and having a heat exchanger for the preparation of hot water, comprising a fire chamber including a bottom wall (7), a rear wall (8, 16) and lateral walls (30);

an air guide system accommodated in the walls for collecting and heating fresh air (42, 43) from outside the room, said air guide system including a bottom duct (11, 12, 14) formed on at least a part of the lower side of the bottom wall (7) and having an air infeed for receiving fresh air (42) from outside the room and a hot air outfeed (15) connected with the fire chamber;

a downdraft duct (22) formed on at least a part (8) of the outside of said rear wall (8, 16) and having an air infeed (at 23) for receiving fresh air (43) from outside of the room and an outfeed (29) for delivering hot air to the room, said air infeed being situated higher than the air outfeed;

a heat exchanger comprising two hollow partitions (7, 8) to be traversed by water for the preparation of hot water, each of said partitions (7, 8) having one side (38, 39) delimiting said fire chamber and another side (9, 41) delimiting the bottom duct (11, 12, 14) and the downdraft duct (22) respectively, thereby being operative to transfer heat on the one side from the fire to the water and on the other side from the water to the fresh air in said bottom duct (11, 12, 14) and in said downdraft duct (22) respectively;

said two hollow partitions (7, 8) of said heat exchanger are mutually adjoining, flat sheet-steel boxes (7, 8) arranged at least approximately at right angles to each other, and the hollow cavities of said boxes, to be traversed by the water, being in communication with each other.

2. A fireplace as claimed in claim 1, including at least one updraft duct (25) formed on at least a part of the outside of one of the lateral walls (30) and having an air infeed (24) connected with the air outfeed (29) of said downdraft duct (22) and an air outfeed (26) for delivering hot air to the room to be heated, said updraft duct air infeed (24) is situated lower than said updraft duct air outfeed (26).

3. A fireplace as claimed in claim 1, including means (31, 32, 45, 46, 53) connected to deliver water to and from said two hollow partitions (7, 8) of said heat exchanger, a temperature sensor at the top of said heat exchanger connected to control said means to interrupt water circulation through the heat exchanger (7, 8) as long as the temperature at said temperature sensor is lower than approximately 60°–70° C.

4. A fireplace as claimed in claim 2, including means (31, 32, 45, 46, 53) connected to deliver water to and from said two hollow partitions (7, 8) of said heat exchanger, a flue duct (19) above said fire chamber, a temperature sensor in said flue duct in the flue gas zone connected to control said means to interrupt water circulation through the heat exchanger (7, 8) as long as the temperature at said temperature sensor is lower than about 40° C.

5. A fireplace as claimed in claim 2, including means (31, 32, 45, 46, 53) connected to deliver water to and from said two hollow partitions (7, 8) of said heat exchanger, a temperature sensor in said updraft duct (25) connected to control said means to interrupt water circulation through the heat exchanger (7, 8) as long as the temperature at said temperature sensor is lower than about 40° C.

6. A fireplace as claimed in claim 1, including pairs of spaced baffles (37, 51) are arranged converging upstream in the heat exchanger (7, 8), distributing the water current over the heat exchange surfaces (9, 38, 39, 41), this arrangement being such that the flow velocity in the region of the heat exchanger exposed most to the heating effect of the fire is higher than in other regions.

7. A fireplace as claimed in claim 1, characterized in that the second hollow partition (8) of said two hollow partitions (7, 8) of said heat exchanger forming a partition between said fire chamber and at least a portion of said downdraft duct (22) is equipped on an upper corner with a water inlet connection (27) and on the other upper corner with a water outlet connection (28), a partition (34) extending in a vertical plane (33) running from the front toward the rear and dividing the second hollow partition (8) of said heat exchanger (7, 8) into two at least approximately equal chambers (35, 36), said partition running up to the lower wall (9) of the first hollow partition (7) of said heat exchanger; and baffles (37) in the first hollow partition (7) oriented obliquely rearwardly toward the plane (33) and further baffles (37) in the second hollow partition (8) oriented obliquely downwardly toward the partition (34) (FIGS. 2–4).

8. A fireplace as claimed in claim 1, including an inlet connection (45) connected at the front edge of the lower wall (9) of the first hollow partition (7) of said two hollow partitions (7, 8) of said heat exchanger leading into the same, and an outlet connection (46); a stand pipe (48) sealed at the bottom and arranged in the longitudinal center of the second hollow partition (8) of said two hollow partitions (7, 8) of said heat exchanger, this stand pipe being cut off for forming a water inlet opening closely beneath the upper limit (49) of the second hollow partition (8); said outlet connection (46) connected with said stand pipe (48), baffles (51) in the first hollow partition (7) oriented for a flow that moves laterally to and fro, additional baffles (51) connected in the second hollow partition (8) oriented obliquely upwardly on both sides of the stand pipe (48); and a connection (52) for an automatic venting means (FIG. 5) at the top of said second hollow partition (8).

9. A fireplace as claimed in claim 1, in which an inlet connection (45) is arranged at the front edge of the lower wall (9) of the first hollow partition (7) of said two hollow partitions (7, 8) of said heat exchanger and leads into the latter; baffles (51) oriented in the first hollow partition (7) for a flow that moves laterally to and fro, additional baffles (51) connected in the second hollow partition (8) of said heat exchanger oriented obliquely upwardly; and an outlet connection (53) (FIG. 5) at the top of said second hollow partition (8).

* * * * *